United States Patent [19]

Mountcastle et al.

[11] 4,010,472

[45] Mar. 1, 1977

[54] ANTENNA SCANNING APPARATUS

[75] Inventors: Paul H. Mountcastle, Glen Burnie; William A. O'Berry, Severna Park, both of Md.

[73] Assignee: Westinghouse Electric Corporation, Pittsburgh, Pa.

[22] Filed: Nov. 14, 1975

[21] Appl. No.: 631,972

[52] U.S. Cl. ..... 343/761; 343/777; 343/840

[51] Int. Cl.[2] ..... H01Q 3/18

[58] Field of Search ..... 343/761, 779, 777, 840

[56] References Cited

UNITED STATES PATENTS

| | | | |
|---|---|---|---|
| 2,895,131 | 7/1959 | Butler | 343/761 |
| 2,991,473 | 7/1961 | Van Staaden | 343/761 |
| 3,500,415 | 3/1970 | Bishop | 343/761 |

*Primary Examiner*—Eli Lieberman
*Attorney, Agent, or Firm*—C. F. Renz

[57] ABSTRACT

A feed which is stationary relative to a parabolic reflector is located in close proximity to a prime focus of the reflector along its central axis. A moving element which is opaque to r.f. energy is moved along a path of revolution about the reflector axis, the path of revolution being located between the reflector and the stationary feed. The shape of the opaque element and the path of revolution are such that different portions of the aperture of the feed are masked as the element travels along the path of revolution. This imparts predictable scanning motion to the beam pattern which is coupled into the stationary feed. One highly useful embodiment of this invention is a construction in which the stationary feed is a secondary feed installed in a nutating feed antenna, and the nutating feed itself constitutes the opaque moving element.

7 Claims, 4 Drawing Figures

ANTENNA SCANNING APPARATUS

BACKGROUND OF THE INVENTION

1. Field of the Invention

This invention relates to feed systems for imparting scanning motion to an antenna, and more particularly to such a feed system for use in an antenna having a focus device, such as a reflector.

2. Description of the Prior Art

There is a need for passive angle tracking to be performed using the antenna of an active conical scan radar. Typically this need arises from a requirement to provide passive angle tracking of external emitters associated with the target being tracked, as in the case of electronic counter measures (E.C.M.) equipment or electronic counter-counter measures (E.C.C.M.) equipment.

One prior approach involves internal modification of the wave guide system of the radar in order to pass the received information to the passive receiver. The disadvantages of this approach include the fact that the sensitivity of both the passive receiver and the tracking radar are diminished, and that the bandwidth of the passive receiver is limited by the r.f. bandwidth of the radar system wave guide.

Included in the common methods of making tracking antennas are beam nutation, beam switching, and beam comparison. These methods use moving feeds, moving antennas, switched or phase shifted feeds or multiple components to derive relative "target" location by means of signal strength versus sense of direction in the appropriate system components. The difficulty in applying these approaches in fulfilling a need for such secondary passive angle tracking antenna, is that they are limited in bandwidth. The function of passive angle tracking of external emitter radiations requires broad bandwidths, namely a bandwidth which is multiple octaves of frequency in width.

Of course, it is also desirable that apparatus for passive angle tracking be inexpensive, easy to manufacture, and easy to install in existing active, conical scan radars.

SUMMARY OF THE INVENTION

A collimating reflector and nutating feed horn for generating conical can beam motion is modified by adding a second stationary feed beyond the loci of revolution of the nutating feed horn. The second feed is of a type having an aperture facing the concave surface of the reflector, and is mounted to the reflector by a pylon made of dielectric rods affixed to the periphery of the reflector. The nutating feed is operatively connected to an active tracking radar, and functions almost exactly as before. A conical scan antenna pattern is developed by the passive feed as the result of its aperture being "masked", or "shadowed" by the nutating feed horn of the active radar. The construction and arrangement is such that the masking of the aperture of the second feed causes partial obstruction of the aperture which varies in a predictable manner as the nutating feed horn follows its path of rotation, thereby producing a nutating antenna pattern at a second feed.

DESCRIPTION OF THE PREFERRED EMBODIMENT

Figure 1:
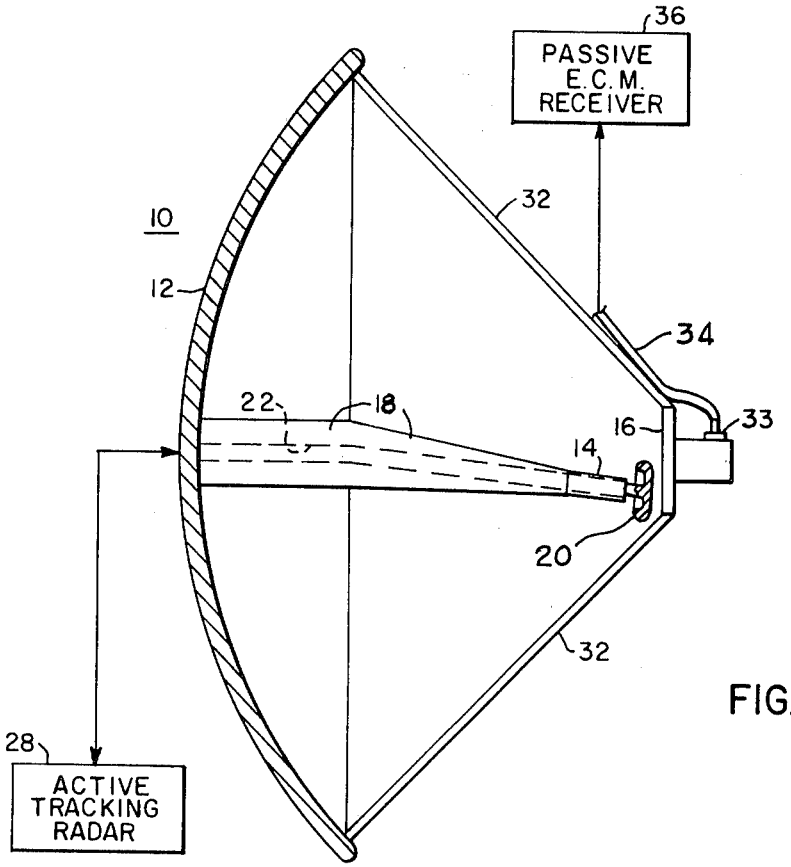
FIG. 1 is a central sectional view of an antenna in accordance with the invention, with certain portions of the feed elements shown in side elevation, and with associated electronic equipment illustrated by block diagram.

Referring now to the drawing and in particular to FIG. 1, an antenna assembly 10 includes a parabolic reflector 12, a primary nutating feed 14, and a secondary fixed feed 16. As will be understood by those of skill in the art, the term "feed" refers to an element of an antenna having a focusing device, which is located at or near the physical prime focus of the device. The feed is the element which couples the r.f. energy to or from the far field of the focusing device from or to the transmission line.

Figure 2:
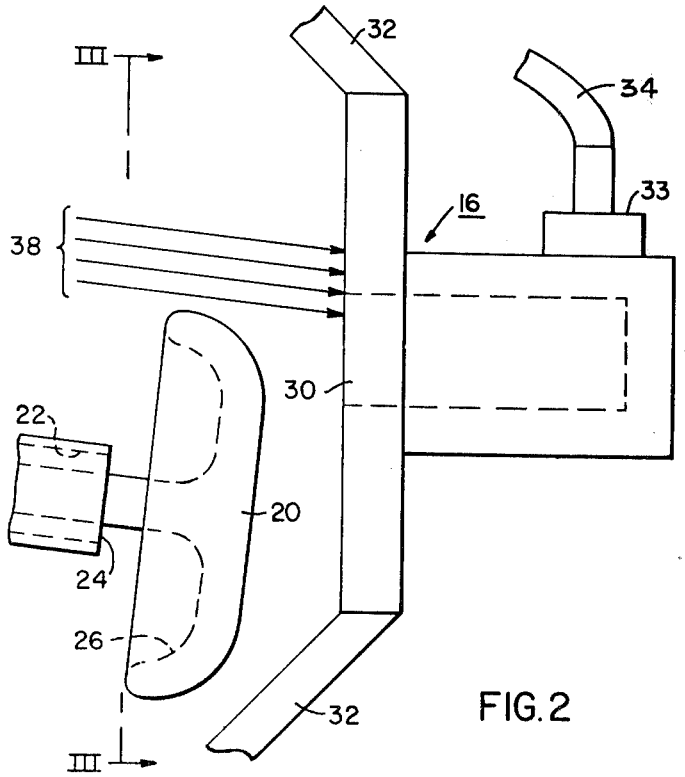
FIG. 2 is an enlarged side elevation of a portion of FIG. 1, certain diagrammatic indications of radiation paths being illustrated for purposes of explanation.

Reference is now made to FIGS. 1 and 2 in conjunction with one another. In and of itself, nutating feed 14 is of a conventional type for generating conical scan movement of a radar beam. It extends from the origin of the axis of reflector 12 outwardly. The portion nearest the reflector constitutes a revolving eccentric mechanism 18. The outer end forms a splash plate-feed horn 20 (shown in section). Within the housing and the eccentric mechanism is a longitudinal wave guide 22, shown by dashed lines which terminates in an annular opening 24. The splash plate is undercut to form an annular concave reflecting surface which causes a reversal of direction or "retrodirection" of r.f. energy impinging thereon, so that at the time of transmission the surface causes the r.f. energy flow from wave guide 22 to irradiate the parabolic reflector. When receiving, the concave surface takes the r.f. image which reflector 12 forms at the prime focus region, and couples it into the wave guide. Wave guide 22 is coupled to a conventional active tracking radar 28.

Figure 3:
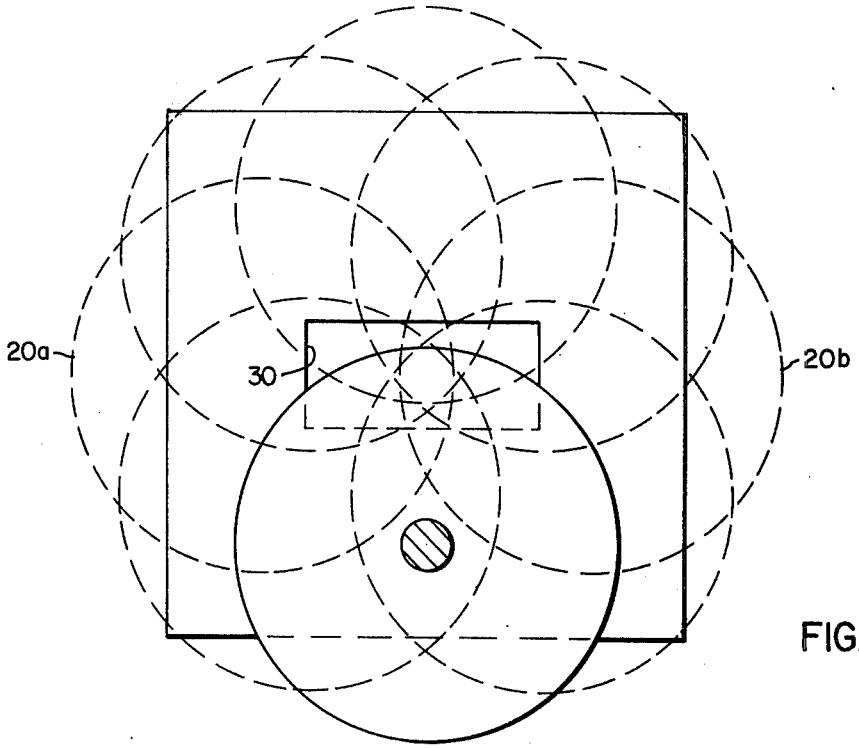
FIG. 3 is a diagrammatic view representing a view generally taken along lines III—III of FIG. 2 illustrating the masking or shadowing of various portions of the aperture of a feed device which takes place under the motion of the nutating feed horn (for simplicity, the shadow areas being shown as perfect circles)

Reference will now be made to FIGS. 1, 2 and 3 for a description of the secondary fixed feed 16. Feed 16 is formed from a commercially available wave guide to coaxial line adaptor. As shown only in FIG. 3, its aperture is a rectangular wave guide opening 30. The feed housing is stationarily mounted in place by means of a pylon constructed of dielectric support rods 32 affixed to the periphery of parabolic reflector 12. R.F. energy received by feed 16 is coupled from the coaxial cable coupling port 33 through a coaxial cable 34 to a passive E.C.M receiver 36. As will become apparent as the description proceeds, secondary feed 16 provides a conical scanned, antenna apparatus directivity beam pattern, and receiver 36 is of the conventional type containing circular conical scanning tracking circuits to derive polar tracking error signals.

In operation, active tracking radar 28 and nutating feed 14 functions almost exactly as though the secondary feed did not exist. In the transmit mode of radar 28 feed horn 20 irradiates r.f. energy onto reflector 12. Reflector 12 concentrates this radiation into a pencil beam, which undergoes conical scanning motion under movement of feed horn 20 along its scan path of rotation. During the receive mode, an object in the far field of the beam from reflector 12 will form a distinct image at the prime focus, which is then coupled into feed horn 20. Referring now to FIG. 2, the presence of feed horn 20 between the reflector 12 and wave guide opening 30 allows only a portion of the r.f. energy arriving from the reflector, indicated schematically by arrows 38 to impinge upon the feed aperture.

Referring now to FIG. 3, the nutating feed acts as a "mask" which partially obstructs different portions of the aperture by effectively placing these zones in a shadow. The variation of the areas of opening 30 which is in such shadow under the rotation of feed horn 20 has been diagrammatically shown by the dashed line position which feed horn 20 takes during a cycle of movement about its circular scan path.

Figure 4:
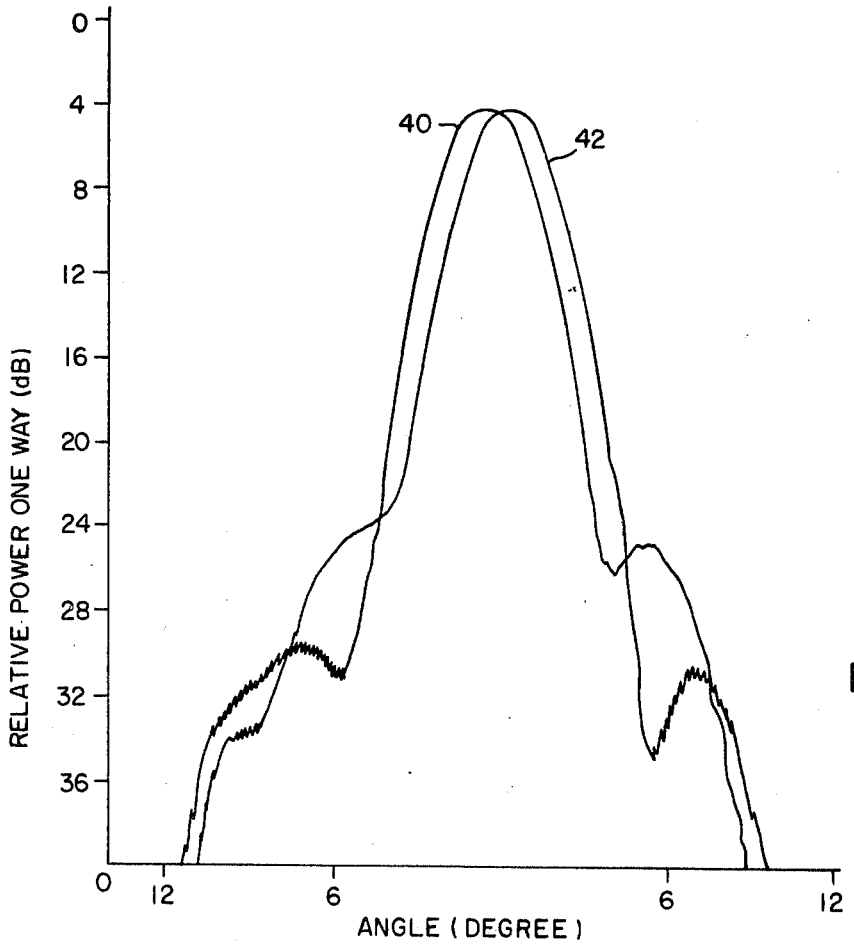
FIG. 4 is a chart presenting antenna patterns of the second feed of the apparatus of FIG. 1 which was made during tests of this apparatus.

Reference is now made to FIG. 4, for a description of the significant beam offset produced by the variation of shadowed area of opening 30 under motion of feed horn 20. The chart of FIG. 4 shows the results of tests performed with the apparatus of FIG. 1. Curve 40 is the antenna pattern coupled through secondary feed 16 with the feed horn splash plate 20 in dashed line position 20*a*. That is, curve 40 represents the antenna pattern generated when the nutating primary feed is pointed to the left of the field into which the reflector is pointing. Curve 20*b* is the antenna pattern for dashed line position 20*b*. It will be appreciated by those of skill in the art, that the variation of the portions of wave guide opening 30 which are shadowed produce enough beam offsets in the antenna pattern of feed 16 to be effective in producing a passive offset lobing function. As the nutating feed 14 moves, the pencil beam of the receive antenna pattern also nutates, thereby producing a conical scan pattern.

Stated another way, the nutating feed casts a shadow over a part of the image being coupled to the prime focus region, and secondary feed 16 collects the remaining portion of the image. If the object beam image is off the boresight axis of the reflector, the image is not scanned in a constant manner. The variation is used in the radar tracking circuit to locate the object in polar coordinates with respect to the boresight axis of the radar.

Although the present invention has been described with secondary feed 16 in the form of an open-ended wave guide section, it will be appreciated that other forms of feeds having distributed aperture may be used as well. Forms of broad band feeds having distributed apertures include: (i) are logarithmically periodic array, (ii) spiral feeds, and (iii) ridged horns.

Similarly although the present invention has been described as a single reflection conical scan device, it will be appreciated that multiple reflectors, and non-circular lobe patterns, where desired, may also be used with this shadowed feed invention to generate additional useful antenna pattern characteristics. Other desirable scan patterns include (i) reciprocating line scan, (ii) repetitive, offset reciprocating line scan, and (iii) elliptical scan. Other commonly used reflectors include (i) Cassegrain, (ii) Gregorian, and (iii) various shaped beam types too numerous to mention. Further, the invention can be adapted for use with so-called "chin fed" reflectors where the primary feed is a scanning horn (not a retrodirecting horn) which is disposed to one side of the line of sight of the collimated beam. Again, the scanning motion of the primary horn would mask or shadow differing portions of a stationary secondary feed.

In tests of apparatus of FIG. 1 it was found that feed 16 provides a passive tracking feed with one-half octave bandwidth. However, those having skill in the art will readily appreciate that the substitution of conventional forms of broad band feeds, like those enumerated in the preceding paragraph, are likely to enable passive tracking over any band of frequencies in which the reflector will properly function. As is well known, parabolic reflectors will inherently effectively function over range of frequencies which is from three to 10 times the bandwidth of operation of the tracking radar. Therefore the present invention can be practiced in a way producing operation bandwidths in the range of several octaves.

Also, it will be appreciated that the present invention permits one to start with an existing, installed, narrow band radar and by means of a simple inexpensive modification to provide the capability to passively track active targets over a broad band of frequencies without reducing the capability of the host antenna in any way. This combination of advantages is very desirable in the practice of the E.C.M. and E.C.C.M. arts.

Although the invention has been described in an embodiment in which the fixed feed is a stationary feed and a primary nutating feed provides the masking, it will be appreciated that the movement of a partial obstruction between the feed and the reflector could be mechanized in any number of ways, and therefore that what is disclosed herein is a new basic construction of tracking antenna. This new construction is characterized by the moving of antenna patterns without moving either the feed causing the beam or the reflector.

Also, all discussions herein have assumed the shadowed feed to be a passive, receive device. This is because it is more easily understood in this format and also because it would not, with present technology, probably tolerate high power. Those of skill in the antenna art will immediately recognize that this device will work as well in the transmit mode as it will in receive mode, provided its power limits are not exceeded. This feed system will also work well on communiction systems for signal tracking.

We claim:

1. Antenna appartus for imparting predictable scanning motion to the antenna beam pattern, said apparatus comprising:

a. a concave parabolic reflector for r.f. energy collimation, said reflector having boresight axis and a predetermined point of focus along said axis, b. first feed means movably mounted relative to the reflector, said first feed means being movable along a predetermined scan path relative to the boresight axis, said first feed means having its aperture facing the reflector, and being constructed of a material which is opaque to the transmission of r.f. energy; and c. second feed means fixedly mounted relative to the reflector and disposed along the boresight axis at a position outwardly from the first feed means, said second feed means having its aperture feeding the reflector, such that the first feed means, when under motion along said predetermined path, forms a partial obstruction masking out ray paths between different portions of the aperture of the second feed means and the reflector to cause the second feed means to produce a scanned directivity beam.

2. Apparatus in accordance with claim 1, wherein;

a. the first feed means is operatively connected to an active radar system, and b. the scanned feed means is operatively connected to a passive radar device.

3. Apparatus in accordance with claim 1, wherein;

a. said predetermined scan path of the first feed means relative to the boresight axis is a path of revolution about the boresight axis.

4. Apparatus in accordance with claim 1, wherein said first movable feed device is a conical scan nutating feed comprising an elongated wave guide element pivotally connected at one of its ends to the reflector essentially at the intersection of the boresight axis and the reflector surface and having a retrodirecting feed horn at the other end, said retrodirecting feed horn following a circular scan path of revolution about the boresight axis whereby the antenna apparatus directivity beam of the second feed means is conically scanned.

5. Beam scanning antenna apparatus comprising:

a. a concave parabolic r.f. energy reflective surface having a central beam axis and a focus point therealong, b. first feed means disposed along said central axis, said first feed means having an aperture facing said reflective surface, and c. second feed means adapted for movement along a predetermined scan path relative to said central axis, said scan path being disposed between the reflector and said first feed means such that the second feed means partially obstructs different portions of the aperture of the first feed means when moving along said predetermined scan path to impact scanning motion to the beam pattern of the antenna relative to the central beam axis of the reflective surface.

6. Apparatus in accordance with claim 5, wherein;

said predetermined scan path is a circular path of revolution about the central axis of the reflective surface, whereby the scanning motion imparted to the beam pattern is conical scanning.

7. Antenna apparatus comprising:

a. a concave parabolic reflector for r.f. energy collimation, said reflector having a boresight axis and a predetermined point of focus along said axis, b. a conical scan nutating feed movably mounted to the reflector, said conical scan nutating feed comprising an elongated wave guide element pivotally connected at one of its ends to the reflector essentially at the intersection of the boresight axis and the reflector surface and having a retrodirecting feed horn at the other end, said conical scan nutating feed being movable along a pedetermined scan path relative to the boresight axis with all positions of the path disposed in proximity to the point of focus, said retrodirecting feed horn having its aperture facing the reflector and following a circular scan path of revolution about the boresight axis;

c. second feed means fixedly mounted to the reflector and disposed along the boresight axis at a position outwardly from the first movable feed means and disposed in proximity to said point of focus, said second feed means having its aperture facing the reflector, d. said conical scan nutating feed being constructed of a material which is opaque to the transmission of r.f. energy, and e. the construction and arrangement being such that the conical scan nutating feed when under motion along said predetermined path forms a partial obstruction masking out ray paths between different portions of the aperture of the second feed means and the reflector, whereby the antenna apparatus directivity beam of the second feed means is conically scanned.

* * * * *